United States Patent [19]

Lubrano

[11] Patent Number: 4,638,654

[45] Date of Patent: Jan. 27, 1987

[54] DEVICE FOR CONTROL OF ROLL CAMBER IN A ROLLING MILL

[75] Inventor: Maurizio Lubrano, Rome, Italy

[73] Assignee: Centro Sperimentale Metallurgico S.p.A., Rome, Italy

[21] Appl. No.: 772,722

[22] Filed: Sep. 5, 1985

[30] Foreign Application Priority Data

Sep. 25, 1984 [IT] Italy ..... 48902 A/84

[51] Int. Cl.[4] ..... B21B 27/10

[52] U.S. Cl. ..... 72/201; 72/236

[58] Field of Search ..... 72/201, 236; 239/551, 239/562, 563

[56] References Cited

U.S. PATENT DOCUMENTS

| | | | |
|---|---|---|---|
| 1,994,721 | 3/1935 | Lorig et al. | 72/201 |
| 2,630,324 | 3/1953 | Lay | 239/551 X |
| 2,811,059 | 10/1957 | Appleby | 72/201 X |
| 2,993,338 | 7/1961 | Wilsted | 239/551 X |
| 3,237,872 | 3/1966 | Mincy | 239/551 X |
| 4,510,784 | 4/1985 | Hsu | 72/201 |

FOREIGN PATENT DOCUMENTS

| | | | |
|---|---|---|---|
| 440124 | 1/1927 | Fed. Rep. of Germany | 239/563 |
| 268159 | 8/1970 | U.S.S.R. | 239/562 |

*Primary Examiner*—E. Michael Combs
*Attorney, Agent, or Firm*—Young & Thompson

[57] ABSTRACT

In rolling, particularly cold rolling of sheets, control of roll camber, and hence of the flatness of the rolled sheet, is ensured by a device fitted with a distributor capable of delivering a thin, continuous, low-turbulence jet of cooling liquid along a generatrix of the roll surface. The distributor is divided transversely into a number of chambers, each having structure allowing a given quantity of water into the chamber, this quantity being variable at will over a wide range. By regulating the quantity of water allowed into each chamber and hence the flow issuing therefrom, the amount of cooling along the body of the roll can be varied, thus varying its camber, so as to influence the flatness of the sheet.

4 Claims, 5 Drawing Figures

DEVICE FOR CONTROL OF ROLL CAMBER IN A ROLLING MILL

DESCRIPTION

The present invention relates to a device for controlling roll camber in a rolling mill. More precisely it concerns the problem of controlling the flatness of the rolled sheet by regulating roll camber by differential and variable cooling along the body of the roll(s) in question.

It is a known fact that in rolling, especially cold rolling of sheet, the constancy of reduction of the sheet—especially in the transverse direction—is of particular importance in order to avoid the undulations that occur in sheet where such reduction is not constant.

Very precise control and regulation is needed to ensure this constancy in reduction, so as to take account of very small variations from one point to another on the sheet; for instance, a variation of a few hundredths of a millimeter in the roll camber might seem insignificant but in actual fact it has an influence on the flatness characteristics of the sheet.

Flatness of rolled sheet depends on a given number of rolling parameters, such as sheet thickness and width, coefficient of reduction, force, tension, etc., some of which, in turn, are influenced at least to some extent by the profile of the rolling body and hence by the roll camber.

Even during cold rolling the rolls tend to heat up to some extent and this temperature-rise may well vary along the body of the roll owing to local differences in some rolling parameters. One of the ways of controlling the roll profile is to ensure differential cooling along the roll body, so that the temperature differences between one zone and another produce a variation in thermal expansion and hence in the roll profile or camber, to achieve the desired profile. It is important to note that in these cases variations in profile of a few hundredths of a millimeter are usually sufficient.

To date, especially where cold rolling is concerned, it has been held that the spraying of water via a sufficient number of jets to cover the body is a satisfactory way of meeting all the necessary requirements.

According to this conventional solution, cooling along the body of the roll is obtained by adjustable valves on each spray, so as to permit regulation which, though stepwise, is none the less fairly continuous. However, it has become apparent, especially with the new high-strength steels, that the system used hitherto suffers from a number of inherent drawbacks.

The most important of these drawbacks lies in the fact that the heat exchange coefficients of spray cooling (in terms of kilocalories removed per unit volume of cooling liquid per hour and per degree centrigrade) and also the cooling efficiency (in terms of kilo-calories removed per unit volume of liquid used) are definitely unsatisfactory, especially because of the brevity of the contact times achieved between the cooling medium and the body to be cooled.

It ensures that to attain the desired cooling effect, large volumes of liquid must be used to ensure the required control of the temperature regime of the rolls.

Another shortcoming concerns the means used to deliver the cooling liquid: spray nozzles and electrically-controlled valves are relatively simple devices but they are also rather delicate. It often happens that several of these devices block up, thus causing a lack of cooling and lubrication in given parts of the roll body; this, in turn, results in the formation of "heat scratches", namely more or less accentuated marks on the sheet, and can also lead to the risk of rupture of the strip, particularly where high-speed rolling is concerned.

Yet another shortcoming lies in the discontinuity in the control of cooling liquid flow rates. This is because the regulation range of a spray nozzle is fairly limited: if the flow rate is too low the nozzle produces no spray and if it is too high the spray rose is too broad and the drops are too small. It is necessary, therefore, to increase the number of nozzles greatly and to reduce their size, thus enormously increasing the risk of some of them becoming blocked.

In any case, with nozzles, it is evident that it is only possible to have stepwise regulation of the total flow delivered.

The present invention is designed to overcome these difficulties by providing a device which can deliver the cooling liquid safely to various zones of the roll body, the liquid being delivered to each zone as a continuous, thin low-turbulence jet.

Another object of the invention is to permit continuous wide-range regulation of the quantity of cooling liquid delivered to each zone.

Yet another object of this invention is to provide a device capable of delivering a continuous, thin jet of cooling liquid along the whole body of the roll, said jet consisting ideally of a large number of zones in each of which the flow rate of the jet can be regulated to values different from those adjacent thereto.

The device which is the subject of this invention consists essentially of a long hollow-shaped distributor positioned in front of the roll body with its main axis parallel to that of the roll; the distributor is divided internally into a number of smaller chambers by continuous dividers fixed to the walls thereof and parallel to its main axis.

Each of these chambers has at least one opening whose size can be varied, for the supply of cooling liquid to the chamber from a manifold, and it also has upper and lower walls converging towards the roll body and terminating a short distance therefrom, said walls forming between them a thin regular-shaped slit at their extremity facing the roll body and parallel thereto. These upper and lower walls of each chamber are continuous with the corresponding walls of the adjacent chambers, so that this thin slit extends continuously along the whole width of the roll body.

The adjustable-size openings in each chamber are obtained by superimposing on one fixed wall of said chamber which has at least one slot, a mobile element in which there is also a slot, said mobile element being moved continuously within the extremes of a pre-established range so that the former and latter slots are more or less superimposed, as the case may be.

Said mobile element forms part of the manifold which supplies the cooling liquid to the chambers of the distributor; this manifold is preferably common to all the chambers of the distributor and there is just one mobile element which extends the whole length of the distributor.

In each of the chambers the slots in the fixed wall and those in the mobile element are parallel to one another but their size and position—transverse to the wall—can be variable and can differ from chamber to chamber.

The present invention will now be described in relation to an embodiment given here purely by way of exemplification and in no respect to be construed as restrictive; said embodiment is illustrated in the accompanying drawings where:

Figure 1:
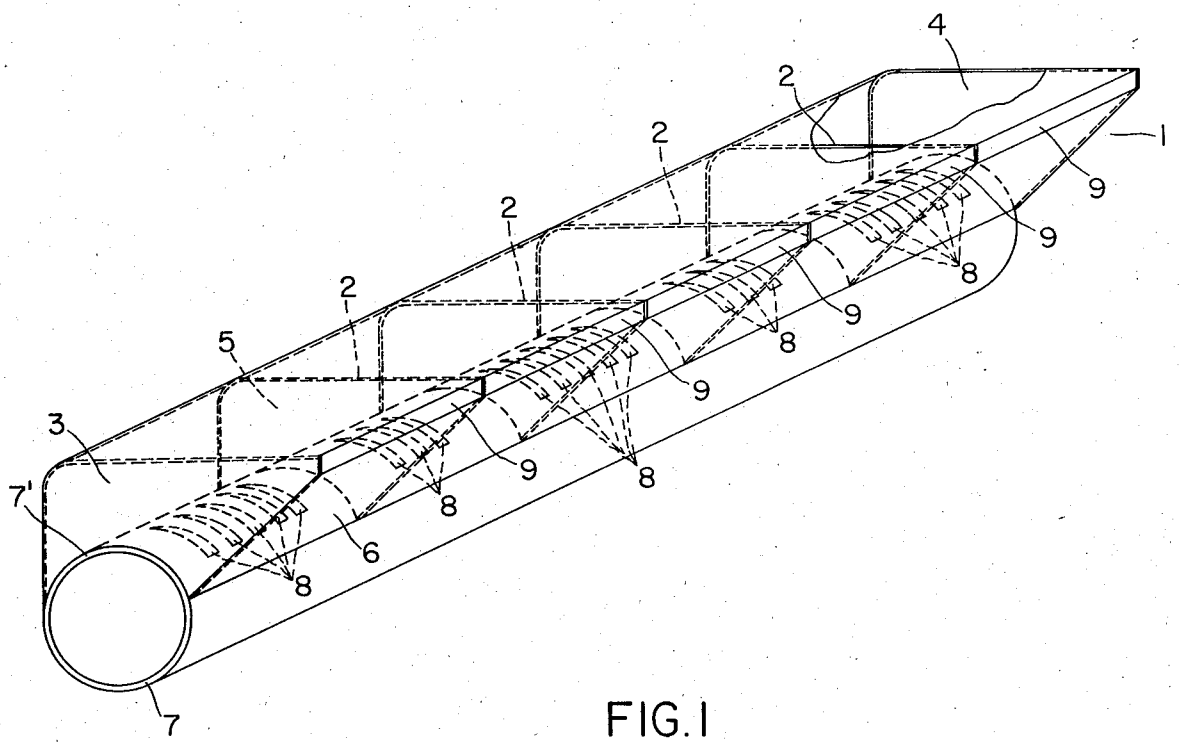
FIG. 1 is a part cutaway isometric view of the manifold and the distributor.

With reference to FIG. 1, distributor 1 is closed at both ends by walls 3 and 4, and is also bounded by walls 5 and 6, as well as wall 7' of manifold 7 that faces onto the inner part of the distributor which is divided internally into a series of chambers by means of dividers 2 that are integral with walls 5, 6 and 7'. In each chamber, wall 7' has slots 8, which in this embodiment are all identical, parallel and in line with one another. Walls 5 and 6 depart from manifold 7 with a convergent configuration but terminate just before they meet, leaving a narrow slit, which extends the whole length of the distributor, being formed of the sum total of fissures 9—one per chamber—bounded transversely by dividers 2 and walls 3 and 4.

Figure 2:
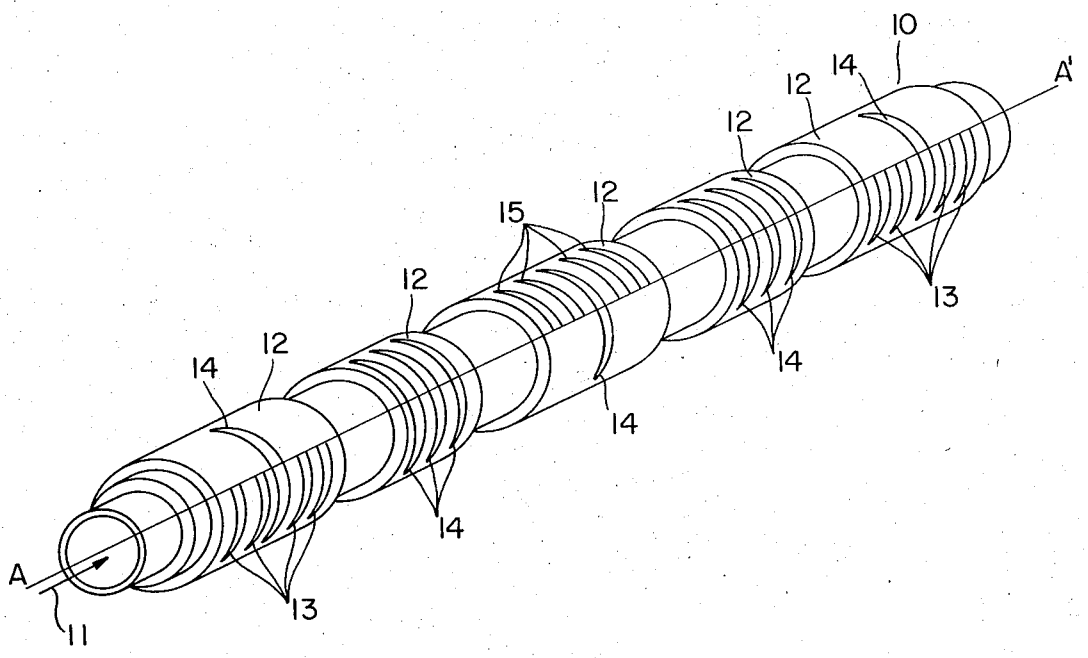
FIG. 2 is an isometric view of the mobile element.

FIG. 2 illustrates the mobile element 10, which is inserted in manifold 7. Mobile element 10 consists of a tube open at one end 11 for the introduction of coolant and closed at the other. The tube preferably has a series of projections 12 in the form of rings jutting out from the surface of tube 10 and integral therewith; these projections 12—one for each chamber—are designed to ensure a leakproof fit with the inner surface of manifold 7 and are complete with slots which match the slots 8 in part 7' of manifold 7; vis-à-vis an index line A—A' the slots 13 are of different length and position.

In the embodiment in question, slots 13 are all on one side of the index line, slots 15 are on the opposite side, while slots 14 extend on both sides of said index line, over the whole arc occupied by slots 13 and 15.

Figure 3:
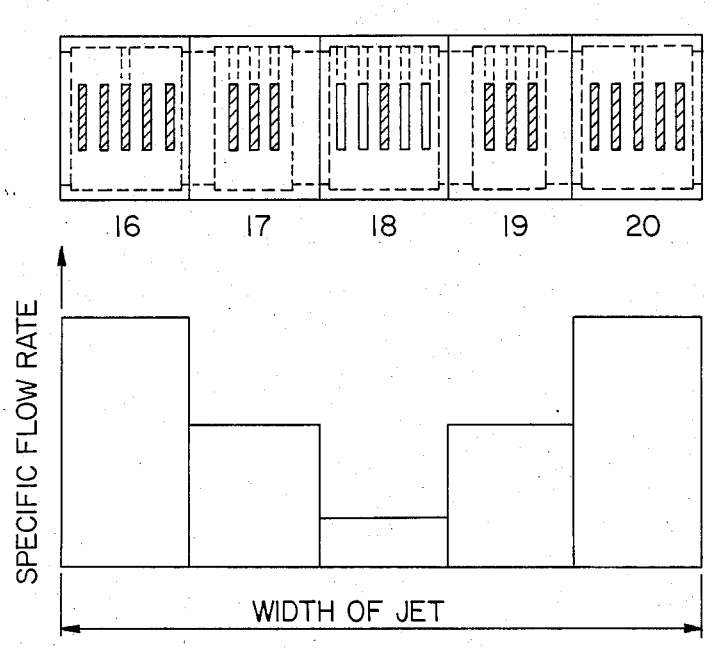
FIG. 3 is a plan view of the device, seen from the slot side, in an extreme setting, together with a diagram indicating the apportionment of the discharge to each chamber.
Figure 4:
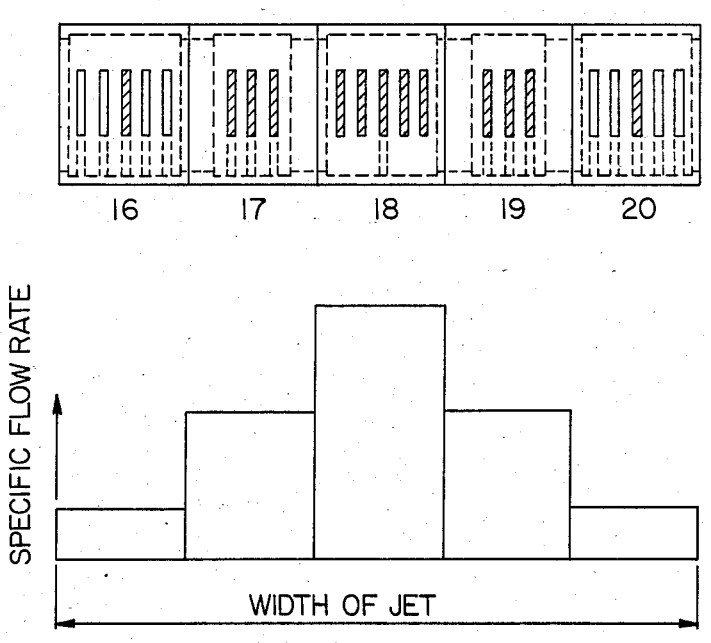
FIG. 4 is a plan view of the device, seen from the slot side in the opposite extreme setting to that in FIG. 3, together with a diagram indicating the apportionment of the discharge to each chamber.
Figure 5:
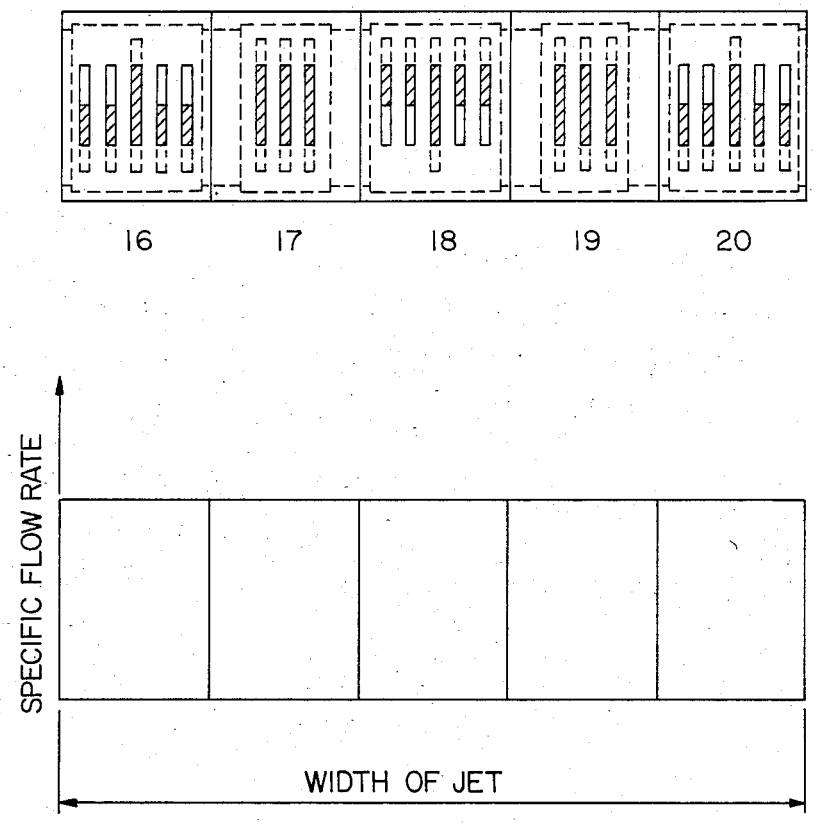
FIG. 5 is a plan view of the device, seen from the slot side in an intermediate setting, together with a diagram indicating the apportionament of the discharge to each chamber.

In FIGS. 3, 4 and 5, the parts indicated with broken lines illustrate the open ways which place the inside of the chambers in communication with the inside of supply manifold 7, through the mobile element 10 when slots 8 are in line with the slots in projections 12.

In the situation illustrated in FIG. 3 all the slots 8 of the zones (or chambers) 16, 17, 19 and 20 are completely in line with the slots (illustrated by broken lines) of mobile element 10, while in zone 18 only one of slots 8 is similarly in line. This results in the zone-by-zone apportionment of discharges illustrated in the histogram-type graph, namely with maximum flows at the ends of the device and a minimum in the middle.

By rotating mobile element 10 to the other extreme position within manifold 7, the opposite situation is attained; this is illustrated in FIG. 4 where it is the middle zones 17, 18 and 19 whose slots 8 are fully in line with the corresponding slots in mobile element 10, while in the end zones 16 and 20 only one slot 8 is similarly lined up. In this case, the maximum flow occurs in the middle of the device and the minimum at the ends, as illustrated by the graph.

In the situation that is exactly intermediate the two described so far, as is seen in FIG. 5, the sum total of the open ways is the same for all the chambers from 16 to 20, so each delivers the same quantity of cooling liquid.

Of course, there is a continuous range of positions between the two extremes illustrated in FIGS. 3 and 4, thus permitting constant variation in flow rates.

As will be readily appreciated, in the embodiment illustrated, the shape and position of the slots in the mobile element at chambers 17 and 19 is such that for any angular position, between the extremes illustrated said chambers 17 and 19 will always deliver the same quantity of cooling liquid.

Quite evidently, it is possible to vary the number, shape and position of the slots chamber by chamber, so as to alter the distribution of the flow rates for each chamber and for each angular position of mobile element 10 at will.

I claim:

1. Device for control of the camber of rolling mill rolls, by which cooling liquid is delivered onto the body of each roll involved, characterized by the fact that said device consists of an elongated, hollow-shaped distributor set with a major axis parallel to the body of the roll and divided internally into several non-intercommunicating chambers by means of dividers that are integral with the walls of said hollow body, said dividers being arranged transversely to said major axis of the distributor; a coolant supply manifold; each of said chambers having a number of adjustable-sized openings on one of its walls for the inflow of cooling liquid from said coolant supply manifold; said device being further provided with means for adjusting the size of said openings; and the distributor itself having upper and lower walls which converge toward the roll body and terminate a short distance therefrom as a narrow slit of uniform width parallel to the roll body and extending the whole length thereof.

2. Device according to claim 1, one of the walls of said distributor having a number of slots located in each of said chambers, a rotatable element fitting leak-proof against said one wall of the distributor, said element having slots therethrough aligned with said slots in said one wall and of varying distribution such that upon rotation of said element, said slots in said element and in said one wall are brought into different degrees of registry with each other.

3. Device as claimed in claim 2, all said slots being parallel to each other.

4. Device as claimed in claim 3, said slots in said element and in said one wall being so disposed that in one extreme rotated position of said element, the flow rate of coolant is at a maximum adjacent both ends of the distributor and at a minimum at the midpoint of the distributor, and that in another extreme rotated position of said element the flow rate of said coolant is at a maximum adjacent the midpoint of the distributor and at a minimum adjacent both ends of the distributor.

* * * * *